US007040237B2

(12) United States Patent
Tilling et al.

(10) Patent No.: US 7,040,237 B2
(45) Date of Patent: May 9, 2006

(54) MUNITION LOADING DEVICE

(75) Inventors: John Tilling, Sevenoaks (GB); Stephen George Gladwell Smith, Sevenoaks (GB); Peter Sutton, Sevenoaks (GB); Stephen Richard Sutton, Sevenoaks (GB)

(73) Assignee: QinetiQ Limited, (GB)

( * ) Notice: Subject to any disclaimer, the term of this patent is extended or adjusted under 35 U.S.C. 154(b) by 41 days.

(21) Appl. No.: 10/489,998

(22) PCT Filed: Sep. 16, 2002

(86) PCT No.: PCT/GB02/04176

§ 371 (c)(1),
(2), (4) Date: Mar. 18, 2004

(87) PCT Pub. No.: WO03/027603

PCT Pub. Date: Apr. 3, 2003

(65) Prior Publication Data

US 2004/0244573 A1 Dec. 9, 2004

(30) Foreign Application Priority Data

Sep. 24, 2001 (GB) ..... 0123637.1

(51) Int. Cl.
*F42B 14/00* (2006.01)

(52) U.S. Cl. ..... 102/524; 102/525; 102/526; 102/527

(58) Field of Classification Search ..... 102/524, 102/525, 526, 527, 528
See application file for complete search history.

(56) References Cited

U.S. PATENT DOCUMENTS 3,439,620 A 4/1969 Crossley et al.
3,613,596 A 10/1971 Walde
3,738,279 A 6/1973 Eyre et al.
4,047,466 A * 9/1977 Berman ..... 89/14.05
4,242,961 A 1/1981 Moredock et al.
4,532,868 A * 8/1985 Gleichaut et al. ..... 102/527
4,552,071 A 11/1985 Horais et al.

(Continued)

FOREIGN PATENT DOCUMENTS

FR 2 612 621 9/1988

(Continued)

*Primary Examiner*—J. Woodrow Eldred
(74) *Attorney, Agent, or Firm*—McDonnell Boehnen Hulbert & Berghoff LLP

(57) ABSTRACT

The invention provides a self-aligning device for aiding the engagement of a munition into a rifled gun barrel on loading of the munition, absent the use of a driving band, as, for example, in the case of a munition which is fitted with aerodynamic tail fins. The device comprises at least one annular ring to surround the munition, and which, if desired, can be seated on a surface of the munition which allows the ring(s) to rotate. One or more of the rings has a number of elements which are capable of lying within the outline of the ring or rings to allow the munition to be readily loaded into a gun barrel but which can take the form of projections extending radially outwards from the ring(s) when they become coincident with the internal rifling of the gun barrel on further movement of the munition along with barrel or when the munition is rotated. The projections then engage in the rifling grooves and provide a sealing effect. Advantageously, one or more rings is/are designed to override one of the other rings when pressure is applied to the device on gun firing so as to cause the device to engage more tightly with the inner surface of the gun barrel and so providing an obturating effect.

42 Claims, 2 Drawing Sheets

U.S. PATENT DOCUMENTS

| | | | | |
|---|---|---|---|---|
| H794 | H | 7/1990 | Telmo et al. | |
| 6,295,934 | B1 * | 10/2001 | Tepera et al. | 102/525 |
| 6,453,821 | B1 * | 9/2002 | Fowler et al. | 102/527 |

FOREIGN PATENT DOCUMENTS

| | | |
|---|---|---|
| WO | WO 01/06201 | 1/2001 |

* cited by examiner

MUNITION LOADING DEVICE

The present invention relates to a device for use in conjunction with munitions where it is necessary to locate a means of engagement with the rifling of a gun barrel from which the munition is to be fired. An example is a munition fitted with a relatively long tail fin unit and which is to be fired from a rifled barrel but with minimum spin being imparted to the munition.

The term "munition" as used herein is meant to encompass as well as a projectile such as a shell or bullet also such a projectile when carried in a sabot or the like, ie any assembly which incorporates a projectile and is intended to be fired from a gun or artillery piece.

A number of situations arise in which it is desired to load a munition into a rifled gun barrel and where some means of engaging with the rifling grooves is employed other than a driving band. The function of the driving band is to impart a spin to the munition as it travels along the barrel in order to stabilise the munition when in flight and hence to make the flight more predictable and targeting easier and more consistent. To do this the driving band is made of a material (eg. copper) that is sufficiently deformable under the pressures created in the gun breech that the band is engraved into the rifling grooves and thus forced into engagement with the rifling in the gun barrel. By making the band a tight fit on the munition, the munition is thus caused to spin as it travels up the barrel of the gun.

However it is not always desired to impart spin to a munition and for this and other reasons, it may not be appropriate to use a driving band. If, however, it is still necessary to arrange for the munition to fit tightly in the gun barrel for purposes of obturation, then other means applied to the munition for engaging with the rifling grooves must be found. Where the engagement means are preformed on the munition, then because of the precision of the fit which is necessary as between the engagement means and the rifling grooves, the two have to be precisely aligned when the munition is loaded into the gun barrel in order for the engagement means to be readily able to enter the rifling grooves at the point where rifling commences in the forcing cone.

An example of a situation where the use of a driving band is not appropriate is where a sabot is used to support a projectile to be fired. Such sabots are designed to fall apart as they exit from the gun barrel. In such cases the sabot may be engraved to engage with the rifling grooves and impart spin to the projectile. For example U.S. Pat. No. 3,738,279 shows a sabot for a sub-calibre projectile which is engraved on its circumference with helical grooves for engagement with the rifling of a gun barrel. The problem of getting the upstands of the engraved portion of the sabot to move smoothly into the rifling grooves when the munition (projectile/sabot combination) is loaded into the gun barrel from which it is to be fired is recognised and is said to be dealt with by modifying the upstands at the front edge with a reverse bevel. However, it is the applicant's opinion that this feature will not suffice to make the upstands self-locating in the rifling grooves in the manner claimed by the U.S. Pat. No. 3,738,279 since the bevelled areas of the upstands will simply collide against the ends of the lands between the grooves (except where, most exceptionally, the two members are precisely aligned beforehand). Previously, the only assured way of achieving the required engagement of engraving with rifling grooves has been by effecting one, or more likely a number, of small rotations of the munition each followed by an attempted axial movement until the correct alignment is found. To do this not only would involve additional mechanical complexity in the loading procedure but would be likely to add significant delay thereto and for both reasons must be regarded as being impractical in an operational context.

One particular example where the loading of a munition may involve difficulties is in relation to munitions which it is desired should have ranges which extend beyond those normally achieved by conventional gun-fired munitions and where measures are adopted which will allow the munition to glide in the later stages of its flight, for example, by the use of controllable canards mounted near the nose end of the munition, together with a guidance and control system. Because the use of such techniques precludes the exploitation of spin to impart stability to the projectile through gyroscopic effects, an alternative solution to stabilisation of the munition in flight has to be found. One way of achieving this is for the munition to be fitted with aerodynamic fins at its rear end. These fins are designed to be deployed immediately after the munition has been fired from the gun to stabilise the munition and also to allow the munition to glide in the later stages of its flight and thus extend its range beyond that which would be reached without the provision of such fins.

In the case of such a fin-stabilised munition it is not required that a high degree of spin should be imparted to the munition as it traverses the gun barrel and hence no driving band is needed. However, if, as is often the case, it is desired to use a gun with a rifled barrel to fire a fin-stabilised munition, then some means is required to achieve obturation in the absence of the driving band. (Although in practice in modern, high-performance guns, an additional sealing (or obturator) ring has often been fitted to munitions even where a driving band is used in order to enhance the sealing action. Such an obturator usually comprises one or more pliable rings placed around the munition and just to the rearward of the driving band).

It will be further appreciated that, for compatibility with existing ballistics requirements and to enable existing charge systems, which occupy a substantial part of the chamber volume, to be loaded, the rear of an aerodynamically-stabilised munition should be co-incident with the position of the rear of a conventional shot when loaded and rammed. With such an aerodynamically-stabilised munition carrying a long fin unit, the front end of the tail fin unit of a munition will, when loaded into the conventional gun as described, take up a position which is some distance along the gun barrel, i.e. away from the forcing cone area of the barrel and extending into the rifled section. Otherwise the rearward end of the fin unit would extend into the chamber space and it would not be possible to use the desired amount of propellant charge. For reasons which will be readily apparent it is not possible to provide effective sealing at the rear of the tail fin unit, in particular where this is made from lightweight, low-strength, materials as is usually desirable. This means that sealing has to be provided on the munition at a point of its greatest calibre and at a position where the mechanical strength is sufficient to carry the setback loads on firing. Such a position will usually be forward of the forward end of the tail fin unit, as some amount of tapering off of the rearward end of the munition is provided for aerodynamic reasons as a transition to the tail fin unit (termed the "boattail"). Furthermore the sealing means must be capable of sealing as soon as the munition is loaded into the gun because it will already be located within the rifled region of the gun barrel at shot start, i.e. it must be at least reasonably effective immediately the gun is fired but not allow the munition to be freely loaded past the forcing cone and into the rifled part of the barrel.

Accordingly it is an object of the present invention to provide an arrangement whereby means that are provided on a munition for the purpose of effecting engagement with the rifling grooves of a gun barrel can be automatically brought into the correct alignment so as to be able readily to enter the grooves when the munition is loaded.

It is a further object of the present invention to provide an obturator which is fully capable of sealing the voids which result from rifling in a gun barrel without necessarily imparting the effect of spin to a munition as it travels along the barrel but which is also configured so as to effect automatic engagement of the obturator into the rifling grooves of the barrel on loading of the munition.

Accordingly the present invention provides a self-aligning device for aiding the engagement of a munition into a rifled gun barrel on loading of said munition, which device comprises at least one annular ring dimensioned for location on said munition and having an external diameter corresponding substantially to the gun bore diameter, and a plurality of elements, dimensioned to be capable of providing a substantially close fit with the rifling grooves of the barrel, disposed on said ring or on at least one of said rings around the circumference thereof, wherein each of the said elements is able to adopt a non-extended position with respect to the said ring so as to permit ready loading of the munition into the barrel, but is biased towards a radially extended position in which it will engage with a corresponding rifling groove on further movement of the munition along the barrel.

Preferably the elements are each located within and are slidable between the radially extended and non-extended positions along an inclined channel formed within the outer surface of said at least one annular ring, said channels being directed substantially axially with respect to said ring. In one embodiment the elements are each individually movable between the extended and non-extended positions.

In an alternative arrangement, the device comprises two annular rings, a first ring carrying said elements and a second ring, co-operative with and biased towards the first, having channels into which respective elements of said first ring are located.

Conveniently, so as positively to retain the elements within their respective channels, each is so shaped that its radially inner surface is of larger dimension than its outer surface and the respective channel is correspondingly shaped, ie with an opening which is narrower than its base or radially inward surface which is the surface on which the element slides.

The bias means can be provided by a spring, a length of elastic material or by a compressible material. Conveniently, the bias is provided by a length of elastic material which is anchored at each end in one of a pair of adjacently disposed elements.

Generally the elements are elongate and are disposed at an angle to the axis of the ring which corresponds to the helical arrangement of the rifling grooves. The number of elements will correspond to the number of grooves in the rifling.

Where the self aligning device is to be used as an obturator it will be dimensioned to be accommodated on the munition in the region of a parallel or tapered portion towards the rearward end thereof. Otherwise it will generally be placed just ahead of any engraved region of the munition as a means of effecting ready loading of such region into the rifling grooves of a rifled gun barrel.

Consequently, in one aspect thereof, the invention provides a device for obturating a munition in a rifled gun barrel which device comprises at least one annular ring dimensioned for location on said munition in the region of a parallel or tapered portion towards the rearward end thereof, said at least one annular ring having an external diameter corresponding substantially to the gun bore diameter, and disposed on said ring or on at least one of said rings around the circumference thereof, a plurality of elements dimensioned to be capable of providing a substantially close fit with the rifling grooves of the barrel characterised in that each of the said elements is able to adopt a non-extended position with respect to the said ring so as to permit ready loading of the munition into the barrel but is biased towards a radially extended position in which it will engage with a corresponding rifling groove on further movement of the munition along the barrel.

A variant of such a device for obturating a munition in a rifled gun barrel comprises two annular rings dimensioned for location on said munition in the region of a parallel or tapered portion towards the rearward end thereof and biased towards each other, said annular rings both having an external diameter corresponding substantially to the gun bore diameter, one of said rings having disposed around its circumference a plurality of axially-extending projections and the second ring being provided with corresponding channels in which said projections are located, the surfaces of said channels being inclined outwardly along their length towards the front of said munition when said device is placed thereon, and the rings being arranged to move in use from a separated to a less separated relation such that, as the rings move into closer relationship, the projections on the second ring are forced radially outwardly by virtue of the inclination of the surfaces of the channels on the first ring, said projections being dimensioned so as to then engage closely with the rifling grooves of the gun barrel.

In this variant therefore, the ring with the elements may be arranged to be connected to what may be termed the "carrier" ring by one or more springs such that when the munition is loaded into the gun barrel and the elements come up against the lands between the rifling grooves as will generally be the case, further forward movement of the munition along the barrel will cause the ring with the elements to move backwards relative to the munition. This continues until sufficient forward movement of the munition as it is loaded has occurred and the elements have become coincident with the rifling grooves of the carrier ring. At this point, under the action of the spring tension, the elements will then start to enter the rifling grooves and continued action of the spring causes the rings to be drawn together and hence the elements to become fully extended outwards by virtue of their movement along the inclined channels in the "carrier" ring.

In an alternative embodiment the elements comprise a plurality of fingers which may be formed integrally with an associated ring and are capable of lying flat in recesses in the surface of the ring or beyond one end of the ring but are biased to take up a position where they will project radially outwardly once coincident on loading with the rifling grooves. The bias may be provided by a spring or the like or the fingers may be formed of a material such as a plastics material having a springy character.

In all cases, the elements capable of extending into the rifling grooves in a gun barrel will be dimensioned so as to at least approximately occupy such grooves once the munition (with the device of the invention attached) has been loaded into the barrel and the elements have become coincident with said grooves. Preferably the elements are so dimensioned as to provide a relatively tight fit therein.

Further arrangements may be adopted to increase the sealing effect of the projecting elements, particularly where the device of the invention is also to function as an obturator. (It is also advantageous that the device should be so constructed that it will be able to compensate for the enlargement of the rifling grooves which takes place progressively as a gun barrel is fired repeatedly and which is a result of mechanical wear owing to friction with the munitions fired and gas erosion). One such arrangement will be to provide that, after firing the gun, the annular ring or rings will be caused to expand radially outwards by a small amount as a result of the device being forced along a tapered portion of the munition under gas pressure, thus forming a tighter fit with the barrel wall. An alternative arrangement may involve the provision of one or more additional rings. In such a configuration at least two and preferably three contiguous annular rings are provided whose adjacent surfaces are correspondingly shaped so that, under pressure applied to the rearmost ring, each ring rides up over the ring in front so as to bring its leading edge into close contact with the inner wall of the gun barrel. The rearmost-ring will carry the projecting elements to provide initiation of the sealing effect of the device after gun firing and before the full effect of sealing is attained by the above-mentioned overriding effect. Additionally, under the very high pressures which obtain in the gun barrel after firing, the elements projecting into the rifling grooves may be caused to distort somewhat so as to conform even more closely to the precise shape of the rifling grooves. In these ways an extremely effective seal can be created.

Preferably each projecting element is provided with a chamfer towards the front of the munition so as to ease its movement into and along the rifling grooves when the gun is fired and to help in avoiding its being broken off as the munition travels along the gun barrel.

A further advantage of the self-aligning device of this invention is that, once located inside the barrel of the gun, the elements are subject to forces of friction between themselves and the barrel wall independently from those experienced by the ring or rings and the rest of the munition body. These forces act in a direction opposite to the direction of movement of the munition/device assembly so that forward movement of the munition and device along the barrel causes the elements to experience rearward forces whilst rearward movement of the munition would cause the elements to experience forces acting in the forwards direction. In the latter case, the forces are additive to those of the bias device and give rise to a motion which tends to cause the elements to adopt the radially extended position as previously described. Such motion causes the normal forces between the elements and the barrel to increase and therefore the friction forces also increase in proportion. This constitutes a positive feedback cycle whereby the greater the rearward force exerted on the munition, the greater becomes the frictional force in the opposite direction. In practice this means that a munition fitted with this device can only be moved in the forward direction. A munition loaded in the barrel of a gun will not therefore fall back when the gun is elevated.

According to a second aspect, the invention provides a munition which is fitted with a self-aligning device as described herein. The device may be designed to effect obturation and may be either fixed to the munition in a static manner or may be rotatable thereon. In either case it will, for obturation purposes, be located towards the rear end of the munition. Alternatively the device may be fitted ahead of an engraved portion of a munition such that the projections on the device line up with the projections on the munition and the device will readily enable the latter to become engaged within the rifling grooves of a gun barrel.

According to a third aspect, the invention provides a method of loading a munition into a rifled gun barrel in which said munition is fitted prior to loading with a self-aligning device according to the invention and is then loaded into a rifled gun barrel.

Whereas, as previously described, the self-aligning device of the invention allows a munition carrying such a device to be straightforwardly loaded into a rifled gun barrel in a single axial movement up the barrel so as to achieve engagement of the device (together with the engraving on the munition, if any) with the rifling grooves, in an alternative method of loading, once the munition with the self-aligning device has been introduced into the forcing cone of the barrel and with the elements on the device pushed back to their radially non-extended position, the munition and device may then be rotated in the barrel until the elements become coincident with the rifling grooves and again are thus enabled to move radially outwards to a position where they are engaged within the rifling grooves. It should be noted that in this case only a single rotation will be required to find the necessary alignment unlike the situation described earlier where a number of trial and error rotations are required where no alignment device is fitted. Consequently this method of loading should extend the loading time by only a very minimal amount and may secure a number of beneficial effects as will be apparent to the skilled person.

Where the device of the invention is mounted on a munition in such a manner that it is able to rotate relative to the surface of the munition (as well as to move along the munition in an axial manner as described previously), the munition is advantageously provided, in the region about which the obturator device of the invention is located thereon, with a suitable bearing surface such as of a metallic material, as for example, steel or aluminium or an alloy thereof or other low-friction material such as PTFE, Karon or the like. For this purpose the low-friction material may be mounted on the munition in the form of a collar inset into the surface of the munition in known manner. Additionally or instead of the above-described arrangement, the interface between the munition and the obturator device may be supplied with a silicone grease material or other appropriate lubrication.

The invention will now be further described with reference to the accompanying drawings in which:—

Figure 1:
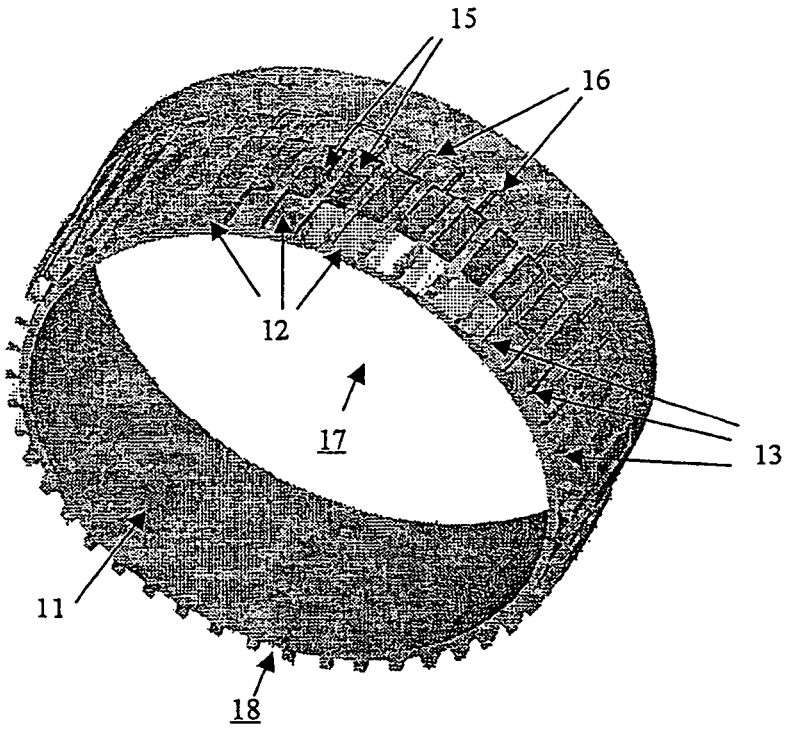
FIG. 1 shows, in perspective an embodiment of a self-aligning device of the invention, comprising one annular ring having individual sliding elements and inclined channels.

In FIG. 1, a single ring 11 is shown which is provided with trapezoidal sectioned channels 12 which are slightly angled with respect to the axis of the ring so as to correspond to the orientation of the rifling grooves in a gun barrel with which the ring is to interface. Within the channels 12 are located axially moveable elements, 15, which can slide along the channels and are shaped to fit the channels so as to be retained within them. The inner surfaces of the channels are inclined along their length so that the channels become less deep towards the front 17 of a munition (not shown) to which ring 11 is fitted. The moveable elements are prevented from sliding out of the channel at the rear end of the ring 11 by the action of lengths of elastic material 16, which urge each element towards a shoulder (not shown) which is formed on the ring and prevents the elements from sliding out of the channels at the other (forward) end thereof. The individual moveable elements are tapered to correspond to the inclination of the inner surface of the channels. When in contact with the shoulder the moveable elements adopt a radially extended position, that is to say, they project above the lands 13 between the channels. However, when a munition carrying such a ring is being loaded into a gun, the elements 15 are enabled to move against the bias of the elastic to a position where their outer faces are flush with the surfaces of the lands 13 that is, towards the rearward face 18 of the device, to permit the munition to enter the rifled part of the barrel. When, during this movement of the munition, the ends of the elements become co-incident with the rifling grooves, the elements move back under action from the elastic material 16 and as such will adopt a radially extended position in which they are each engaged with a rifling groove in the barrel wall.

When the device is being used as an obturator, the munition is loaded as described. On the gun being fired, the moveable elements, which are suitably shaped at their rearward end to capture gas and provide a low pressure seal, are forced further along the channels towards the above-mentioned shoulder and so move radially outwardly further as a result of the inclining of the groove surfaces. Consequently they project further above the lands 13 and engage more deeply with the rifling so as to create an effective high pressure seal.

Figure 2:
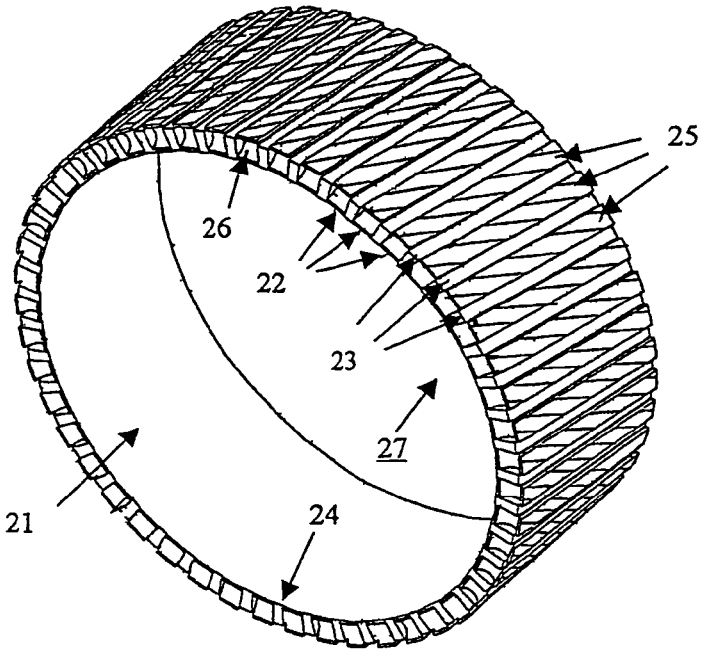
FIG. 2 shows, in perspective, an embodiment of a self-aligning device of the invention, comprising two annular rings respectively having co-operating elements and inclined channels.

In FIG. 2 an arrangement of two rings is shown in which one ring 21 is provided with channels 22 extending parallel to the helical rifling grooves of the barrel. Between the channels are intervening lands 23. The inner surfaces of the channels are inclined along their length so that the channels become less deep towards the front of the munition 27. The second ring 24, placed with respect to the first towards the rear of the munition, carries a series of elements 25 extending parallel to the helical rifling grooves and arranged to lie within the channels of the first ring when the rings are brought adjacent. The elements are tapered to correspond to the inclination of the surface of the channels. When the munition is loaded and introduced into the barrel, if the rifling is not co-incident with the ends of the elements, the elements are pushed back against a bias arrangement between the rings (not shown) until continuing forward movement of the munition into the gun barrel brings the elements co-incident with the rifling grooves, allowing them to move forwards under the effect of the biasing arrangement and consequently, as a result of the inclining of the channel surfaces, outwards into the rifling grooves, that is, so that the elements begin to project above the lands 23 as shown. On the gun being fired, the elements, which are suitably shaped at their rearward end 26 to capture gas and provide a low pressure seal, are forced along the channels in the first ring as the rings are brought into intimate contact under gas pressure and so move further outwardly and more deeply into the rifling so as to effect an effective high pressure seal.

Figure 3:
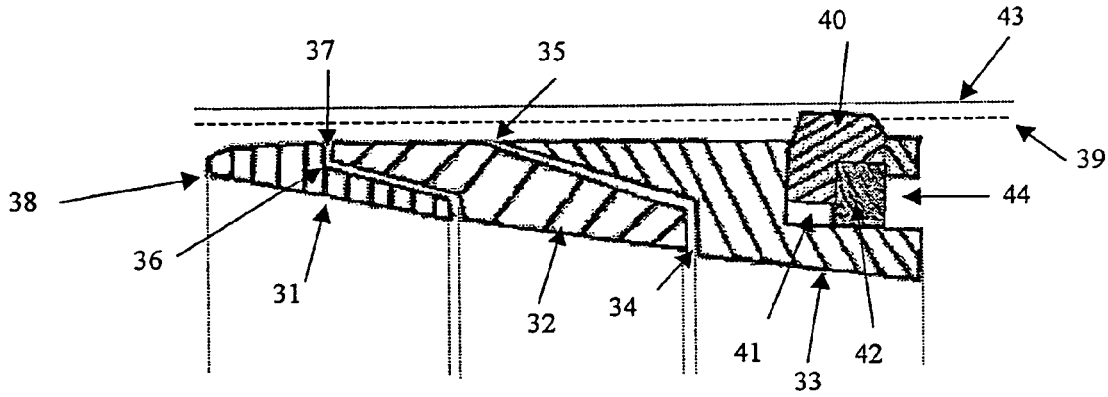
FIG. 3 is a sectional view of a further embodiment of the invention in combination with two other rings in a triple ring arrangement.

The obturator shown in FIG. 3 is an elaborated version of the single and double ring arrangements of FIGS. 1 and 2 respectively, having instead three rings, 31, 32, 33, the last of which is of an alternative design to those shown in FIGS. 1 and 2. As can be seen the rings when placed alongside each other in an at rest position conform approximately to the outline of the single or double rings as shown in FIGS. 1 and 2. However, once the gun is fired and pressure is applied to the rearmost ring 33, in addition to the force which this ring then applies to ring 32 through the interface 34, ring 33 is caused to slide partially over ring 32 causing the front edge of the former to project slightly outwardly and into firmer contact with wall 39 of a gun barrel. Likewise with ring 32 where the leading edge 37 is caused to ride up over the front ring 31 and hence to project slightly outwardly of the rear edge 36 of the step in front ring 31. Consequently, with this embodiment, in addition to the main sealing surface provided by the elements 40 on the rearmost ring, the leading edge of each of the rings provides some additional sealing effect.

It will be appreciated that, in general the ring carrying the moveable elements will be the rearmost ring 33 in the type of arrangement that is shown in FIG. 3. This rearmost ring may be of the same type as the ring shown in FIG. 1 or could be a two-ring device of the kind shown in FIG. 2. Alternatively ring 33 can be of a different design, as illustrated in FIG. 3, and it should be appreciated that, while in FIG. 3 the rearmost ring has a section such that it may be used in conjunction with rings 31 and 32, a ring of the same general form as ring 33 can be used on its own in place of either the single ring device of FIG. 1 or the two-ring device of FIG. 2.

Ring 33, instead of having slidable elements as in the embodiments of FIGS. 1 and 2, is provided with a series of movable elements 40 which are spaced apart circumferentially around the perimeter of the ring so as to coincide with the spacing between the grooves of the barrel rifling as measured in a plane at right angles to the barrel axis. Such elements 40 are capable of acting as radially outwardly-extending projections or studs (as shown in FIG. 3), but can be depressed to a radially non-extended position by virtue of being seated on blocks 42 of elastically deformable material. The elements 40 are comprised of a robust material such as nylon so as to withstand being forced to move against the inner surface of the gun barrel as the munition travels up the barrel. Block 42 is conveniently made of a rubbery material.

Each stud 40 together with its associated block 42 is located within an aperture 41 provided within the ring 33, the whole being retained therein by means of silicon rubber adhesive or the like. In this arrangement, when the device is introduced into the gun barrel in conjunction with a munition to which it is fitted, the rubber block 42 is compressed and allows stud 40 to be depressed to a position where it lies flat with the outer surface of the ring 33. Once the stud becomes coincident with a rifling groove on continued entry of the munition into the barrel, however, the block 42 is able to return to its normal expanded condition and stud 40 is thus urged into the rifling groove (the depth of which is indicated in FIG. 3 by the broken line at 43) to form a low pressure seal. When the gun is fired, gas pressure, acting on the under-surface of the stud via an aperture 44 in the rear face of ring 33 causes the stud or peg 40 to be forced further outwards and into more intimate contact with the rifling groove in the barrel thereby forming an effective seal against gas leakage in the same manner as described previously.

The skilled person will readily appreciate that other arrangements of movable elements and other means to bias such elements towards adopting a location within the rifling grooves are possible and all such arrangements are understood to be within the scope of this invention

The invention claimed is:

1. A self-aligning device for aiding the engagement of munition into a rifled gun barrel on loading of said munition, which device comprises at least one annular ring dimensioned for location on said munition and having an external diameter corresponding substantially to the gun bore diameter, and a plurality of elements, dimensioned to be capable of providing a substantially close fit with the rifling grooves of the barrel, disposed on said ring or on at least one of said rings around the circumference thereof, wherein each of the said elements is able to adopt a non-extended position with respect to the said ring so as to permit ready loading of the munition into the barrel, but is biased towards a radially extended position in which it will engage with a corresponding rifling groove on further movement of the munition along the barrel wherein said elements are located within and are slidable between the radially extended and non-extended positions along inclined channels formed within the outer surface of said at least one annular ring.

2. A device as claimed in claim 1 wherein said channels are directed substantially axially with respect to said ring.

3. A device as claimed in claim 1 wherein said elements are each individually movable between the extended and non-extended position.

4. A device as claimed in claim 1 wherein there are two annular rings, a first ring carrying said elements and a second ring, co-operative with and biased towards the first, having channels into which respective elements of said first ring are located.

5. A device as claimed in claim 1 wherein the radially inner surface of each element is of larger dimension than its outer surface and the respective channel is correspondingly shaped so as positively to retain the element within said channel.

6. A device as claimed in claim 1 wherein the bias is provided by a spring, an elastic material or compressible material.

7. A device as claimed in claim 3 wherein the bias is provided by a length of elastic material which is anchored at each end in one of a pair of adjacently disposed elements and is otherwise attached to the ring.

8. A device as claimed in claim 1 wherein said elements are elongate and disposed at an angle to the axis of the ring which corresponds to the helical arrangement of the rifling grooves.

9. A device as claimed in claim 1 which is dimensioned to be accommodated at the front end of the munition.

10. A device as claimed in claim 1 which is dimensioned to be accommodated on the munition in the region of a parallel or tapered portion towards the rearward end thereof and to act as an obturating device.

11. A device for obturating a munition in a rifled gun barrel which device comprises at least one annular ring dimensioned for location on said munition in the region of a parallel or tapered portion towards the rearward end thereof, said at lest one annular ring having an external diameter corresponding substantially to the gun bore diameter, and disposed on said ring or on at least one of said rings around the circumference thereof, a plurality of elements dimensioned to be capable of providing a substantially close fit with the rifling grooves of the barrel, characterised in that each of said elements is able to adopt a non-extended position with respect to the said ring so as to permit ready loading of the munition into the barrel, but is biased towards a radially extended position in which it will engage with a corresponding rifling groove on further movement of the munition along the barrel wherein said elements are located within and are slidable between the radially extended and non-extended positions along inclined channels formed within the outer surface of said at least one annular ring.

12. A device for obturating a munition in a rifled gun barrel which comprises two annular rings dimensioned for location on said munition in the region of a parallel or tapered portion towards the rearward end thereof and biased towards each other, said annular rings both having an external diameter corresponding substantially to the gun bore diameter, one of said rings having disposed around its circumference a plurality of axially-extending projections and the second ring being provided with corresponding channels in which said projections are located, the surfaces of said channels being included outwardly along their length towards the front of said munition when said device is placed thereon, and the rings being arranged to move in use from a separated to a less separated relation such that, as the rings move into closer relationship, the projections on the second ring are forced radially outwardly by virtue of the inclination of the surfaces of the channels on the first ring, said projections being dimensioned so as to then engage closely with rifling grooves of the gun barrel.

13. A device as claimed in claim 10 and provided with at least one further ring over which, in use of the device, one at least of the at least one annular rings will override so as to provide a more effective seal between said device and said gun barrel.

14. A device as claimed in claim 13 wherein there are three rings in total.

15. A device as claimed in claim 1 wherein the at least one annular ring is rotatable on the munition.

16. A device as claimed in claim 1 wherein the at least one annular ring is fixed on the munition.

17. A munition fitted with the device of claim 1.

18. A munition as claimed in claim 17 wherein said munition comprises a low friction surface in the region of contact with said self-aligning device.

19. A munition as claimed in claim 18 wherein said low friction surface comprises at least one of steel, aluminium and polytetrafluorethylene (PTFE).

20. A munition as claimed in claim 17 and further provided with means to lubricate the surface of the munition in the region of contact with the device.

21. A method of loading a munition into a rifled gun barrel which comprises fitting the munition with a device according to claim 1 and then loading the munition by pushing it along the barrel until elements on the device become fully located into the rifling grooves of the barrel.

22. A method of loading a munition into a rifled gun barrel which comprises fitting the munition with a device according to claim 1 and then loading the munition into the gun by pushing it along the barrel until there is resistance to such motion, rotating the munition until elements on the device become located into the rifling grooves of the barrel and further pushing the munition until the said elements are fully located into said rifling grooves.

23. A device as claimed in claim 11 and provided with at least one further ring over which, in use of the device, one at least of the at least one annular rings will override so as to provide a more effective seal between said device and said gun barrel.

24. A device as claimed in claim 12 and provided with at least one further ring over which, in use of the device, one at least of the at least one annular rings will override so as to provide a more effective seal between said device and said gun barrel.

25. a device as claimed in claim 23 wherein there are three rings in total.

26. A device as claimed in claim 24 wherein there are three rings in total.

27. A device as claimed in claim 11 wherein the at least one annular ring is rotatable on the munition.

28. A device as claimed in claim 12 wherein the at least one annular ring is rotatable on the munition.

29. A device as claimed in claim 11 wherein the at least one annular ring is fixed on the munition.

30. A device as claimed in claim 12 wherein the at least one annular ring is fixed on the munition.

31. A munition fitted with the device of claim 11.

32. A munition as claimed in claim 31 wherein said munition comprises a low friction surface in the region of contact with said self-aligning device.

33. A munition as claimed in claim 32 wherein said low friction surface comprises at least one of steel, aluminium and polytetrafluorethylene (PTFE).

34. A munition as claimed in claim 31 and further provided with means to lubricate the surface of the munition in the region of contact with the device.

35. A munition fitted with the device of claim 12.

36. A munition as claimed in claim 35 wherein a low friction surface in the region of contact with the device.

37. A munition as claimed in claim 36 wherein the low friction surface comprises steel, aluminium, PTFE or Karon.

38. A munition as claimed in claim 35 and further provided with means to lubricate the surface of the munition in the region of contact with the device.

39. A method of loading a munition into a rifled gun barrel which comprises fitting the munition with a device according to claim 11 and then loading the munition by pushing it along the barrel until elements on the device become fully located into the rifling grooves of the barrel.

40. A method of loading a munition into a rifled gun barrel which comprises fitting the munition with a device according to claim 12 and then loading the munition by pushing it along the barrel until elements on the device become fully located into the rifling grooves of the barrel.

41. A method of loading a munition into a rifled gun barrel which comprises fitting the munition with a device according to claim 11 and then loading the munition into the gun by pushing it along the barrel until there is resistance to such motion, rotating the munition until elements on the device become located into the rifling grooves of the barrel and further pushing the munition until the said elements are fully located into said rifling grooves.

42. A method of loading a munition into a rifled gun barrel which comprises fitting the munition with a device according to claim 12 and then loading the munition into the gun by pushing it along the barrel until there is resistance to such motion, rotating the munition until elements on the device become located into the rifling grooves of the barrel and further pushing the munition until the said elements are fully located into said rifling grooves.

* * * * *